US005530317A

United States Patent [19]

Willemsen et al.

[11] Patent Number: 5,530,317

[45] Date of Patent: Jun. 25, 1996

[54] HIGH-PRESSURE METAL HALIDE DISCHARGE LAMP WITH ELECTRODES SUBSTANTIALLY FREE OF THORIUM OXIDE

[75] Inventors: Martin F. C. Willemsen, Eindhoven, Netherlands; Paul D. Goodell, Ridgewood, N.J.; Willem Van Erk, Eindhoven, Netherlands; Hui-Meng Chow, Briarcliff Manor, N.Y.

[73] Assignee: U.S. Philips Corporation, New York, N.Y.

[21] Appl. No.: 320,037

[22] Filed: Oct. 7, 1994

[30] Foreign Application Priority Data

Oct. 7, 1993 [BE] Belgium ..... 09301051

[51] Int. Cl.[6] ..... H01J 61/073

[52] U.S. Cl. ..... 313/633; 313/630; 313/346 R

[58] Field of Search ..... 313/630, 633, 313/346 R, 491, 574, 575, 631, 632

[56] References Cited

U.S. PATENT DOCUMENTS 3,700,951 10/1972 Clarke et al. ..... 313/346
4,052,634 10/1977 De Kok ..... 313/346 R
4,136,227 1/1979 Saito et al. ..... 313/346 R
4,303,848 12/1981 Shimizu et al. ..... 313/346
4,574,219 3/1986 Davenport et al. ..... 315/49

FOREIGN PATENT DOCUMENTS 0136726 4/1985 European Pat. Off. ..... H01J 61/073

*Primary Examiner*—Nimeshkumar D. Patel
*Attorney, Agent, or Firm*—Brian J. Wieghaus

[57] ABSTRACT

The high-pressure metal halide discharge lamp has tungsten electrodes in a light-transmitting lamp vessel which is closed in a vacuumtight manner. The electrodes comprise an emitter which is distributed throughout their mass and is formed by a first oxide chosen from hafnium oxide and zirconium oxide and by a second oxide chosen from yttrium oxide, lanthanum oxide, cerium oxide and scandium oxide, and are substantially free from thorium oxide. The lamp retains its initial light output to a high degree throughout its life.

16 Claims, 1 Drawing Sheet

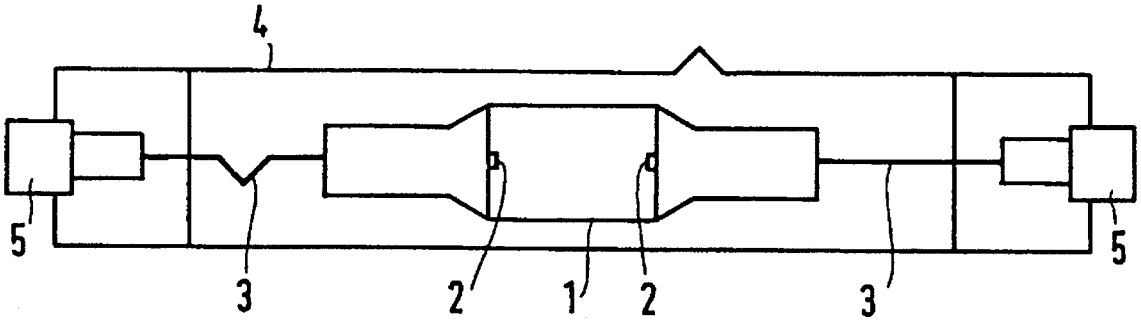
4
5
3
2
1
2
3
5

HIGH-PRESSURE METAL HALIDE DISCHARGE LAMP WITH ELECTRODES SUBSTANTIALLY FREE OF THORIUM OXIDE

BACKGROUND OF THE INVENTION

The invention relates to a high-pressure metal halide discharge lamp provided with a light-transmitting lamp vessel which is sealed in a vacuumtight manner and contains an ionizable filling with rare gas and metal halide, and in which tungsten electrodes are arranged connected to current conductors which issue to the exterior through the lamp vessel, which electrodes are provided with an oxidic electron emitter.

Such a high-pressure metal halide discharge lamp is known from U.S. Pat. No. 4,574,219.

Near their free ends, the electrodes of the known lamp are provided with, for example coated with, a cermet of tungsten and metal oxide chosen from the oxides of scandium, aluminium, dysprosium, thorium, yttrium, and zirconium and mixtures thereof. The cermet in this case comprises 2 to 30% by weight metal oxide.

It is the object of these electrodes to render it possible that the lamp quickly enters its operational state after starting and that a preceding period of a glow discharge is avoided. For this purpose, the cermet is porous so that the electrodes have a low thermal conductivity and consequently quickly assume their operational temperature.

The complicated structure of the electrodes and the resulting complicated manufacture of the electrodes constitute a disadvantage. Another disadvantage of the known lamp is the use of the radioactive thorium oxide. This represents a severe strain on the environment, both during its manufacture and during manufacture of the electrodes, and also at the end of lamp life. Another disadvantage is that the emitter is comparatively quickly exhausted when oxides other than thorium oxide are used.

Emitter is usually present in or on electrodes in discharge lamps for facilitating the emission of electrons. In proportion as the emitter has a lower work function compared with the electrode material without emitter the electrode will assume a lower temperature during operation. The evaporation of electrode material and deposition of the vapour on the lamp vessel are smaller then. A result of this is that the lamp has a higher luminous maintenance: its initial luminous efficacy (lm/W) is better maintained during lamp life. It is in particular the noxious thorium oxide which has a low work function.

EP 0,136,726-A2 discloses a high-pressure sodium discharge lamp in which similar oxidic materials are used as emitters. In or on the electrodes there are present one or several of the oxides of yttrium, lanthanum, cerium, hafnium, thorium, beryllium and scandium. These oxides are more stable than BaO which is sometimes used as an emitter in high-pressure sodium discharge lamps, and are accordingly supposed to counteract the loss of sodium from the lamp vessel.

U.S. Pat. No. 3,700,951 discloses high-pressure sodium and high-pressure mercury discharge lamps which have refractory electrodes with an emitter arranged in a cylinder at the free end of each of these electrodes, which emitter is made of tungsten, molybdenum or tantalum with a first metal chosen from the lanthanides and thorium and a second metal chosen from elements having atomic numbers 22 to 28, 44 to 46 and 76 to 78, the alloy of said first and second metal moistening the tungsten, molybdenum or tantalum. These lamps have similar disadvantages as does the lamp mentioned first.

U.S. Pat. No. 4,303,848 discloses a high-pressure discharge lamp in which a sintered body has been placed on an electrode rod of tungsten, which body is built up from tungsten, molybdenum, tantalum, and mixtures thereof, with an oxide of yttrium, zirconium, aluminium and mixtures thereof, and with an alkaline earth compound serving as the emitter. The purpose of the oxide here is to replace thorium oxide in preventing contact between the alkaline earth compound and the metal. Therefore, comparatively large quantities of oxide of up to 30% by weight are used.

SUMMARY OF THE INVENTION

It is an object of the invention to provide a high-pressure metal halide discharge lamp of the kind described in the opening paragraph whose electrodes are substantially free from thorium oxide, while the lamp nevertheless has a comparatively high lumen maintenance.

According to the invention, this object is achieved in that the electrodes comprise, distributed in their mass, a first oxide chosen from hafnium oxide and zirconium oxide and a second oxide chosen from among yttrium oxide, lanthanum oxide, scandium oxide and cerium oxide, and are substantially free from thorium oxide, while the second oxide accounts for M mole % of the sum of the second oxide and the first oxide, M having the values listed in Table 1:

TABLE 1

| first oxide (I) | second oxide (II) | M (mole % II) |
|---|---|---|
| $HfO_2$ | $Y_2O_3$ | 5–60 |
| $ZrO_2$ | $Y_2O_3$ | 5–65 |
| $HfO_2$ | $La_2O_3$ | 30–40 |
| $ZrO_2$ | $La_2O_3$ | 30–40 |
| $HfO_2$ | $Ce_2O_3$ | 25–40 |
| $ZrO_2$ | $Ce_2O_3$ | 30–35 |
| $HfO_2$ | $Sc_2O_3$ | 5–44 |
| $ZrO_2$ | $Sc_2O_3$ | 5–44 |

When the lamp contains more than one second oxide, each second oxide has its own quantity of first oxide in relation to which it has a molar percentage M. For example: supposing the lamp contains $Y_2O_3$ and $La_2O_3$ and a first oxide $M^IO_2$, then the molar percentages $M_Y=Y_2O_3*100\%/(Y_2O_3+\{M^IO_2\})$ and $M_{La}=La_2O_3*100\%/(La_2O_3+[M^IO_2])$ comply with the values of the Table, and the total (molar) quantity $M^IO_2=\{M^IO_2\}+[M^IO_2]$.

When the lamp has two first oxides, then the percentual (molar) quantity M of the second oxide is given in relation to the sum of the second oxide and its own quantities of each of the first oxides. For example, if the lamp comprises $Y_2O_3$ and two first oxides, then the following is true:

$$M_Y=Y_2O_3*100\%/(HfO_2+Y_2O_3+ZrO_2)=5–60$$

The electrodes of the high-pressure metal halide discharge lamp according to the invention are substantially free from thorium oxide. Nevertheless, the lamp has a good lumen maintenance. This is remarkable because the first oxides have a comparatively high work function A (eV) which is only slightly lower than that of tungsten itself and much higher than that of thorium oxide, as is evident from Table 2.

TABLE 2

| substance | A (eV) |
|---|---|
| W | 4.5 |
| $ZrO_2$ | 4 |
| $HfO_2$ | 3.8 |
| $ThO_2$ | 2.6 |

On the basis of these data, one would have to conclude that the first oxides are hardly suitable for use as emitters, least of all for the purpose of the invention. The first oxides would cause a comparatively high electrode temperature because they emit with difficulty, and the tungsten vapour pressure would be comparatively high and blackening of the lamp vessel comparatively quick.

The second oxides have a considerably lower work function than the first, although slightly higher than $ThO_2$, as is evident from Table 3.

TABLE 3

| substance | A (eV) |
|---|---|
| $Y_2O_3$ | 2.8 |
| $La_2O_3$ | 3.1 |
| $Ce_2O_3$ | 3.2 |
| $ThO_2$ | 2.6 |

The second oxides, however, have a comparatively high volatility at elevated temperature. When distributed throughout the mass of tungsten electrodes in a quantity of 30% by volume, for example, yttrium oxide is found to have lost 39.85% and 79.2% of its mass after heating for 10 hours in vacuo at 2625 and 2775K, respectively. Deposition of the—white—oxide on the lamp vessel is indeed less detrimental to the lumen maintenance of the lamp than deposition of black tungsten, but an electrode having a second oxide as its emitter will soon have spent its emitter.

Surprisingly, the combination of a first oxide with a second oxide in the tungsten electrode leads to a substantially smaller loss of emitter material, as was demonstrated by a furnace experiment in which the electrodes listed in Table 4 were heated in vacuo for 10 hours.

TABLE 4

| electrode | vol % oxide | M (mole %) | $\Delta m_{2625K}$ (%) | $\Delta m_{2775K}$ (%) |
|---|---|---|---|---|
| $W + Y_2O_3$ | 30 | 100 | 39.85 | 79.2 |
| $W + HfO_2$ | 30 | 0 | 8.0 | 11.5 |
| $W + Y_2O_3 + HfO_2$ | 30 | 20 | 8.0 | 8.1 |
| $W + Y_2O_3 + HfO_2$ | 30 | 43 | 14.6 | 20 |
| $W + Y_2O_3 + HfO_2$ | 30 | 57 | 8.85 | 12.0 |
| $W + Y_2O_3 + HfO_2$ | 7 | 25 | 6.85 | 6.95 |
| $W + Y_2O_3 + HfO_2$ | 7 | 33 | 4.1 | 5.3 |
| $W + Y_2O_3 + HfO_2$ | 7 | 50 | 7.1 | 9.1 |

Table 4 shows that the emitter material mass loss $\Delta m_{2625K}$ and $\Delta m_{2775K}$ at 2625 and 2775K, respectively, is much lower for electrodes of the lamp according to the invention than for electrodes containing only yttrium oxide. It is noted in this connection that the temperature of 2775K is not reached in all lamp types during normal operation. This temperature and the vacuum conditions, accordingly, were only chosen for obtaining a clear indication as to the stability of the emitter material in a short test.

It is remarkable that the oxide loss in the presence of hafnium oxide (lines 3 to 8 of Table 4) is much lower than in the absence of this oxide (line 1). It is even more remarkable that the loss is very low in the case of a comparatively low oxide content of 7% by volume (lines 6 to 8), even lower than the in itself much smaller loss of hafnium oxide of an electrode comprising this oxide only (line 2).

It was found that hafnium oxide and yttrium oxide yield stable mixtures of oxides with a structure of the fluorite type over a wide range of stoicheometries. This may explain the wide mixing range in which these oxides can be used successfully as emitter materials in the electrodes. Other combinations of a first oxide and a second oxide also yield such stable mixtures of oxides and/or stable mixed oxides at or close to the composition $M^{II}{}_2M^{I}{}_2O_7$, in which $M^{II}$ is the metal of the second oxide and $M^{I}$ the metal of the first oxide, albeit with different solubilities of the components in these mixed oxides. Such stable mixed oxides may have structures of the fluorite, pyrochlore, or other crystallographic type. In general, the mixed oxides have a higher melting point and/or a lower vapour pressure than the corresponding second oxide.

In an actual lamp according to the invention, an emitter will generally be chosen to have a comparatively high content of the second oxide, because this has a comparatively low work function. On the other hand, the emitter may be optimized in that the loss of emitter material of the electrode is lower in the case of a lower content. When yttrium oxide is used as the second oxide, the same quantity up to 2.33 times as much first oxide will preferably be added thereto (M=30–50 mole % ). When scandium oxide is used as the second oxide, somewhat less than equal quantities up to two times as much of a first oxide is preferably added thereto ( M=30–44 mole %). When a different second oxide is used, approximately twice the quantity of first oxide will preferably accompany it (M=approximately 33 mole %).

Similar data of other combinations of a first and a second oxide are represented in Table 4a.

TABLE 4a

| | vol % oxide | M (mole %) | $\Delta m_{2625K}$ (%) | $\Delta m_{2775K}$ (%) |
|---|---|---|---|---|
| $W + Sc_2O_3$ | 30 | 100 | | 72.1 |
| $W + Sc_2O_3 + ZrO_2$ | 30 | 20 | | 9.6 |
| $W + Sc_2O_3 + ZrO_2$ | 30 | 40 | | 9.9 |
| $W + Sc_2O_3 + ZrO_2$ | 8 | 40 | | 5.2 |
| $W + Sc_2O_3 + ZrO_2$ | 30 | 40 | | 7.3 |
| $W + La_2O_3$ | 30 | 100 | >80 | |
| $W + Ce_2O_3$ | 30 | 100 | >80 | |
| $W + La_2O_3 + ZrO_2$ | 30 | 33 | 57.0 | |
| $W + La_2O_3 + HfO_2$ | 30 | 33 | 45.0 | |
| $W + Ce_2O_3 + ZrO_2$ | 30 | 33 | 39.2 | |
| $W + Ce_2O_3 + HfO_2$ | 30 | 33 | 7.6 | |

It is also essential to the invention that the emitter material is present distributed throughout the mass of the electrode and not in a layer provided at the surface of the electrode, as is the case in all embodiments described in the cited U.S. Pat. No. 4,574,219. It can only evaporate then when it has come to the surface of the electrode through transport along the boundaries of the tungsten particles, while evaporated emitter material can be supplemented from the mass.

The structure of the electrode is also important in that the emitter material, which is enveloped in tungsten during storage of the electrode and during lamp manufacture, cannot or substantially not be exposed to influences of the ambient air and to pollution and/or dissociation owing to, for example, moisture. In addition, the mixed oxides are less sensitive to such influences than are their components. This is illustrated by an experiment in which pellets of $La_2Hf_2O_7$, of $La_2O_3$+$HfO_2$, and of $La_2O_3$ were stored exposed to air.

After 48 hours of storage the weight gain of these pellets was 0, 1.4, and 2.99% respectively.

The structure is also important in that it renders it possible for the high-pressure metal halide discharge lamp to be operated, if so desired, at electrode temperatures at which the emitter material, which is enveloped under pressure, would be molten under atmospheric pressure. Owing to the incorporation in tungsten, it cannot change its composition anywhere except at the electrode surface. The stability of the emitter material allows manufacturing steps of the electrode, such as sintering, at comparatively high temperatures under atmospheric pressure.

The quantity of emitter material in the electrodes may be chosen between wide limits, also depending on the type of high-pressure metal halide discharge lamp. In general, 1 to 30% by volume will suffice, which will result, also depending on the oxides chosen, in quantities of up to no more than approximately 10% by weight. With quantities in the lower portion of the volume range indicated, electrodes may be readily obtained which have the emitter material finely dispersed in the tungsten matrix. In the higher portion, from approximately 25% by volume upwards, a transition is seen to a structure with a network of emitter material in the tungsten matrix, which accelerates the transport of emitter material to the electrode surface. When used in lamps with rare-earth halides and/or scandium halide in the ionizable filling, an emitter material content of up to 5% by weight is usually sufficient, for example, approximately 2% by weight; for other high-pressure metal halide discharge lamps this is a content of approximately 10% by weight. A cyclical process takes place in lamps with rare-earth halides which returns first and second oxides to the electrodes in the form of the corresponding halides.

It is noted that aluminium oxide, which is useful in the lamp according to the cited U.S. Pat. No. 4,574,219, in substantial quantities is detrimental in the lamp according to the invention. Firstly, this oxide is found to evaporate substantially during heating steps in the manufacture of the electrode material; secondly, it is found to lead to a coarsening of the structure of the material.

Loss of emitter material at the surface is found to be compensated from the mass through diffusion. If a comparatively quick evaporation of the emitter material at the surface takes place owing to lamp operation with a high electrode temperature, and diffusion of emitter material along particle boundaries of the tungsten is not sufficient for compensation, a comparatively high emitter material content can be used so that the emitter material is present partly in a network structure and an accelerated transport to the surface also takes place by way of the network.

Sintered electrodes manufactured by powder metallurgy were used for testing the emitter material. The powder material was manufactured by various techniques, for example, by the sol-gel method, ball mill operation, etc. Little difference was found in the properties of the electrodes obtained. Sintered electrodes are highly suitable for small quantities of material and small numbers of electrodes. Preference is given, however, to the lamp according to the invention with electrodes manufactured from drawn material, obtained through drawing of sintered rods. Drawn material is characterized by tungsten crystals which have a much greater dimension in the longitudinal direction of the wire or rod than transversely thereto.

The tungsten of the electrodes may have the usual impurities and additions which control the particle growth of tungsten such as potassium, aluminium and silicon up to a total of, for example, 0.01% by weight of the tungsten.

Depending on the type of high-pressure metal halide discharge lamp, the electrodes may have various shapes and dimensions. Thus an electrode may have a winding at or adjacent its free end, for example of tungsten wire, for example of the tungsten material of which the electrode itself was manufactured. Such a winding may be used for providing a desired temperature gradient across the electrode during lamp operation or for facilitating starting. Alternatively, the electrodes may be of, for example, spherical or hemispherical shape at their free ends.

The electrodes may be arranged, for example, next to or opposite one another in the lamp vessel. The lamp vessel may be made of a glass with a high $SiO_2$ content, for example of quartz glass, but alternatively, for example, of a crystalline material such as, for example, polycrystalline aluminium oxide or sapphire. The lamp vessel may be accommodated in a closed outer envelope, if so desired.

BRIEF DESCRIPTION OF THE DRAWING

An embodiment of the high-pressure metal halide discharge lamp according to the invention is shown in the drawing in side elevation.

DESCRIPTION OF THE PREFERRED EMBODIMENTS

In the drawing, the high-pressure metal halide discharge lamp is provided with a light-transmitting lamp vessel 1, made of quartz glass in the drawing, which is closed in a vacuumtight manner. The lamp vessel contains an ionizable filling with rare gas and metal halide. The filling of the lamp shown comprises mercury, iodides of sodium, thallium, holmium, thulium, and dysprosium, and 100 mbar argon. Tungsten electrodes 2 are arranged in the lamp vessel and connected to current conductors 3, made of molybdenum in the Figure, which issue to the exterior through the lamp vessel. The electrodes are provided with an oxidic electron emitter. The lamp shown has a quartz glass outer envelope 4 which carries lamp caps 5.

The electrodes-2 have, distributed in their mass, a first oxide chosen from hafnium oxide and zirconium oxide and a second oxide chosen from yttrium oxide, lanthanum oxide, scandium oxide and cerium oxide, and are substantially free from thorium oxide, the second oxide accounting for M mole % of the sum of the second oxide and first oxide together, M having the values listed in Table 1.

TABLE 1

| first oxide (I) | second oxide (II) | M (mole % II) |
|---|---|---|
| $HfO_2$ | $Y_2O_3$ | 5–60 |
| $ZrO_2$ | $Y_2O_3$ | 5–65 |
| $HfO_2$ | $La_2O_3$ | 30–40 |
| $ZrO_2$ | $La_2O_3$ | 30–40 |
| $HfO_2$ | $Ce_2O_3$ | 25–40 |
| $ZrO_2$ | $Ce_2O_3$ | 30–35 |
| $HfO_2$ | $Sc_2O_3$ | 5–44 |
| $ZrO_2$ | $Sc_2O_3$ | 5–44 |

The lamp shown consumes a power of 75 W.

The lamp was manufactured with electrodes containing various emitter materials according to the invention and was compared with lamps which have other emitter materials but are identical in all other respects. The electrodes were manufactured in that tungsten powder was mixed with powder of the relevant oxides. The mixture was densified and sintered, whereby rod-shaped electrodes of 360 μm thickness were obtained with a density representing a high percentage of the theoretical density, approximately 97%. Electrodes of lower density may also be used, however, for other types of lamps, such as types not containing rare-earth metal and/or scandium in the filling.

The lamps were operated for 1000 h and their electrode temperatures were measured, as was their lumen maintenance (maint.). After 1000 hours of operation, individual lamps of each type were opened and the thickness d was measured of the electrode surface layer in which no emitter material was present.

The results are listed in Table 5.

TABLE 5

| electrode | T (K) | maint. (%) | d (μm) |
|---|---|---|---|
| W | 2820 | 65 | — |
| W + 2 vol % $Y_2O_3$ | 2760 | 72 | 330 |
| W + 2 vol % $HfO_2$ | 2730 | 69 | 680 |
| W + 2 vol % $ThO_2$ | 2710 | 80 | 250 |
| W + 2 vol % $ThO_2$* | 2560 | 94 | 30 |
| W + 1 vol % $HfO_2$ + 1 vol % $Y_2O_3$ | 2610 | 92 | 40 |

*from drawn wire.

It is clear from Table 5 that the lamp having electrodes containing only tungsten has a high electrode temperature, while the electrodes emit with difficulty and lumen maintenance is low. The lamp shows strong blackening owing to the evaporation and deposition of tungsten caused by the high temperature.

Electrodes with yttrium oxide or with hafnium oxide have a somewhat lower, but still comparatively high temperature, and result in a comparable bad maintenance. There is a strong, in the case of hafnium oxide very strong oxide depletion at the surface. The oxides evaporate and are supplemented too slowly from the electrode mass.

Sintered electrodes with thorium oxide have a temperature comparable to that of electrodes with hafnium oxide, but yield a better maintenance. The depletion depth is also smaller than in the preceding lamps.

Lamps with electrodes from drawn wire have the lowest electrode temperature and a high, indeed the highest maintenance. There is a remarkable difference with lamps having sintered thoriated tungsten electrodes both as regards the temperature and as regards maintenance.

The lamp according to the invention has an electrode temperature which is only 50° higher than that of the preceding lamp, but 100° lower than that of the sintered thoriated tungsten electrode. Lumen maintenance is comparable to that of the lamp having drawn thoriated electrodes, but much better than that of the lamp having sintered thoriated electrodes. The depletion depth, accordingly, is very small. The evaporation of emitter material is small and is substantially compensated from the mass. Remarkable are the differences, in temperature as well as in depletion depth and in maintenance, between the lamp according to the invention and the lamp containing only the first or only the second oxide. This clearly demonstrates the synergetic effect of these oxides.

Other lamps were made which had a rare gas, mercury and a mixture of sodium iodide, thallium iodide and indium iodide as their ionizable filling. These lamps had electrodes selected from those mentioned in Table 6. Their maintenance and luminous efficacy after 1000 hours of operation are represented in said table, too.

TABLE 6

| electrode | maint. (%) | η (%) |
|---|---|---|
| W + 18 vol % $ThO_2$ | 92 | 74 |
| W + 30 vol % ($Y_2O_3$ + $HfO_2$) | 90 | 67 |
| W + 30 vol % $La_2Hf_2O_7$ | 95 | 75 |

It is apparent from Table 6, that the lamps having thoriated electrodes are only slightly better than the lamps having $Y_2O_3/HfO_2$ as the emitter in the electrodes. $La_2Hf_2O_7$ even gives better results with respect to maintenace as well as luminous efficacy than thoria.

We claim:

1. A high-pressure metal halide discharge lamp, comprising:

a light-transmitting lamp vessel sealed in a vacuumtight manner and containing an ionizable filling with rare gas and metal halide, tungsten electrodes arranged within said lamp vessel between which a discharge is maintained during lamp operation, and current conductors connected to said electrodes which issue to the exterior through the lamp vessel, which electrodes comprise, distributed in their mass, an oxidic electron emitter including a first oxide chosen from hafnium oxide and zirconium oxide and a second oxide chosen from among yttrium oxide, lanthanum oxide, scandium oxide and cerium oxide, and are substantially free from thorium oxide, while the second oxide accounts for M mole % of the sum of the second oxide and the first oxide, M having the values listed in Table 1:

TABLE 1

| first oxide (I) | second oxide (II) | M (mole % II) |
|---|---|---|
| $HfO_2$ | $Y_2O_3$ | 5–60 |
| $ZrO_2$ | $Y_2O_3$ | 5–65 |
| $HfO_2$ | $La_2O_3$ | 30–40 |
| $ZrO_2$ | $La_2O_3$ | 30–40 |
| $HfO_2$ | $Ce_2O_3$ | 25–40 |
| $ZrO_2$ | $Ce_2O_3$ | 30–35 |
| $HfO_2$ | $Sc_2O_3$ | 5–44 |
| $ZrO_2$ | $Sc_2O_3$ | 5–44 |

2. A high-pressure metal halide discharge lamp as claimed in claim 1, characterized in that, (a) with yttrium oxide chosen as the second oxide, the first oxide is present within the range of 1 to 2.33 times the molar quantity of the yttrium oxide, (b) with lanthanum oxide chosen as the second oxide, approximately twice as much of the first oxide is present relative to the lanthanum oxide and (c) with cerium oxide present as the second oxide, approximately twice as much of the first oxide is present relative to the cerium oxide.

3. A high-pressure metal halide discharge lamp as claimed in claim 2, characterized in that hafnium oxide is the first oxide.

4. A high-pressure metal halide discharge lamp as claimed in claim 2, characterized in that the oxidic electron emitter accounts for up to 10% by weight of the electrodes.

5. A high-pressure metal halide discharge lamp as claimed in claim 4, characterized in that the lamp contains a metal halide chosen from the group comprising scandium halide and rare-earth halides, and the oxidic electron emitter accounts for up to 5% by weight of the electrodes.

6. A high-pressure metal halide discharge lamp as claimed in claim 5, characterized in that the oxidic electron emitter accounts for approximately 2% by weight of the electrodes.

7. A high-pressure metal halide discharge lamp as claimed in claim 2, characterized in that the oxidic electron emitter accounts for up to 10% by weight of the electrodes.

8. A high-pressure metal halide discharge lamp as claimed in claim 7, characterized in that the lamp contains a metal halide chosen from the group comprising scandium halide and rare-earth halides, and the oxidic electron emitter accounts for up to 5% by weight of the electrodes.

9. A high-pressure metal halide discharge lamp as claimed in claim 8, characterized in that the oxidic electron emitter accounts for approximately 2% by weight of the electrodes.

10. A high-pressure metal halide discharge lamp as claimed in claim 1, characterized in that hafnium oxide is the first oxide.

11. A high-pressure metal halide discharge lamp as claimed in claim 10, characterized in that the oxidic electron emitter accounts for up to 10% by weight of the electrodes.

12. A high-pressure metal halide discharge lamp as claimed in claim 11, characterized in that the lamp contains a metal halide chosen from the group comprising scandium halide and rare-earth halides, and the oxidic electron emitter accounts for up to 5% by weight of the electrodes.

13. A high-pressure metal halide discharge lamp as claimed in claim 12, characterized in that the oxidic electron emitter accounts for approximately 2% by weight of the electrodes.

14. A high-pressure metal halide discharge lamp as claimed in claim 1, characterized in that the oxidic electron emitter accounts for up to 10% by weight of the electrodes

15. A high-pressure metal halide discharge lamp as claimed in claim 14, characterized in that the lamp contains a metal halide chosen from the group comprising scandium halide and rare-earth halides, and the oxidic electron emitter accounts for up to 5% by weight of the electrodes.

16. A high-pressure metal halide discharge lamp as claimed in claim 15, characterized in that the oxidic electron emitter accounts for approximately 2% by weight of the electrodes.

* * * * *